United States Patent [19]

Hergeth et al.

[11] Patent Number: 4,528,723

[45] Date of Patent: Jul. 16, 1985

[54] APPARATUS FOR FEEDING FIBROUS MATERIAL IN THE FORM OF FLOCKS TO PROCESSING MACHINES

[75] Inventors: Hubert A. Hergeth; Helmut H. A. Hergeth, both of Dülmen, Fed. Rep. of Germany

[73] Assignee: Hergeth Hollingsworth GmbH, Fed. Rep. of Germany

[21] Appl. No.: 499,886

[22] Filed: Jun. 1, 1983

[30] Foreign Application Priority Data

Jun. 8, 1982 [DE] Fed. Rep. of Germany ..... 3221536

[51] Int. Cl.[3] ..... D01G 15/40

[52] U.S. Cl. ..... 19/105; 19/97.5

[58] Field of Search ..... 19/105, 97.5, 64.5; 406/70

[56] References Cited

U.S. PATENT DOCUMENTS 4,219,289 8/1980 Trützschler ..... 19/105 X 4,394,790 7/1983 Keller et al. ..... 19/105

4,404,710 9/1983 Wood ..... 19/105

*Primary Examiner*—Louis K. Rimrodt

*Attorney, Agent, or Firm*—Diller, Ramik & Wight

[57] ABSTRACT

A feeding device for flocculent fiber material, e.g., cotton, synthetic fibers, etc., to processing machines, such as carding engines, etc., including an inlet which feeds fiber material through an intake roller and an opening roller into an inlet end portion of a duct, the duct having an outlet end portion at which are located take-off rollers for feeding the fiber material from the duct, the opening roller having a width corresponding to the predetermined width of the duct inlet end portion, and a transverse air current blower extending the predetermined width of the duct inlet end portion and the opening roller, the transverse air current blower being positioned above the duct inlet end portion and having an outlet directed downwardly into the duct inlet portion, and the transverse air current blower being operative at low air pressures and high air throughput.

4 Claims, 4 Drawing Figures

APPARATUS FOR FEEDING FIBROUS MATERIAL IN THE FORM OF FLOCKS TO PROCESSING MACHINES

The invention relates to an apparatus for feeding flocculent fiber material, e.g. cotton, synthetic fibers etc. to processing machines such as a carding engine etc.

It has been known to feed flocculent material in that the fibers are absorbed via intake rollers by means of a quench duct, that they are opened by an opening device, e.g. a beater roller, to be subsequently condensed in a duct by means of a vibrating device and continuously withdrawn by take-off rollers and fed to the processing machine, the filling height of the duct being controlled by a scanning means, e.g. a selenium cell or ultrasound barrier.

For a better condensing and distribution of the flocks etc., air is introduced by blowing in different ways, e.g. by fan valves or by propeller fans. The fans or air flaps may generate a blast over the total width of the condensing duct. While the flocks are condensed, it is not possible for them, due to the quick acceleration, to be distributed uniformly over the width of the duct. When beaten from the opener roller, the fibers are cast by the air jet on the already existing material column. With propeller fans, the distribution can be improved by adjusting the pressure, but this is at the expense of condensation. Another disadvantage involved with propeller fans, is the different pressure and air distribution over the width of the duct.

The propeller fans absorbing the air at a small site only to discharge it again via a pipe at another site, it is not possible, within the limited space conditions of the feeding device, to obtain a uniform air blast distribution over the width of the compacting duct. As a result, condensation over the width of the duct is unequal and therefore, the processing of the flocks in the subsequent processing machine, for inst. in a carding engine, cannot be uniform either.

It is the object of the invention to improve, to intensify and realise more safely the uniformity of the distribution of flocks over the width of the condensing duct. One feature of the invention is characterized in that, for blowing air into the duct, a cross current ventilator is provided that extends over the total width of the duct to uniformly absorb the air over the duct width and to uniformly supply and press air into the duct.

By this kind of blowing the uniformity of the material column under formation in the duct is substantially improved by simple means and with great reliability. By blowing air according to the invention, low pressures and high air throughputs allow to convey flocks to sites at which less material is present. The cross current ventilator is operating correctly and the stated essential advantages are achieved with a reduced constructional expenditure.

As an additional feature of the invention for obtaining the uniformity of the material, a particular drive is provided for the intake means of the feeding device.

The control of the height of the material column in the duct is performed by a scanning device, e.g. an ultrasound barrier. To this effect, the drive of the intake rollers was cut off, considering a certain delay time, when the material column had reached the predetermined height. As a result, the operation of the feeding device is discontinuous. Material had been supplied in intervals. According to another feature of the invention, a motor having at least two speeds is provided to ensure a uniform feed to the processing machine in case of some kinds of materials. The motor is used in such a way that upon reaching of the filling height, the quick speed is changed over to the slow speed while material is further supplied. If, by the removal of the material from the feeding device, the filling level drops again below the light barrier or the like, the motor changes over to quick speed operation to fill the duct until the filling heigh again surpasses the predetermined level so that a change-over to slow motion will take place accordingly. The resultant feeding will be continuous and more uniform.

To avoid overfilling of the feeding means in case of an interruption of the removal of the material, a time lag is provided to stop the intake if, for a certain time, no changeover to quick operation took place. If the material level in the duct has decreased to below the level mark of the scanning device and the signal for the quick operation is given, the intake system becomes operative again. At the same time, discontinuous feeding is converted to continuous feeding, whereby the improved uniformity of supply to the processing machine is not affected.

The invention will be explained hereunder by an embodiment illustrated in the drawing.

Figure 1:
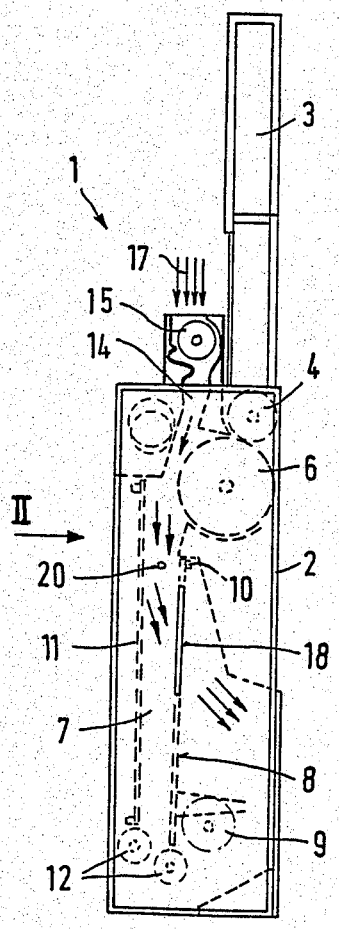
FIG. 1 shows a schematic side view of one embodiment of the feeding device of the invention to supply flocks or the like to a processing machine, e.g. a carding engine.
Figure 2:
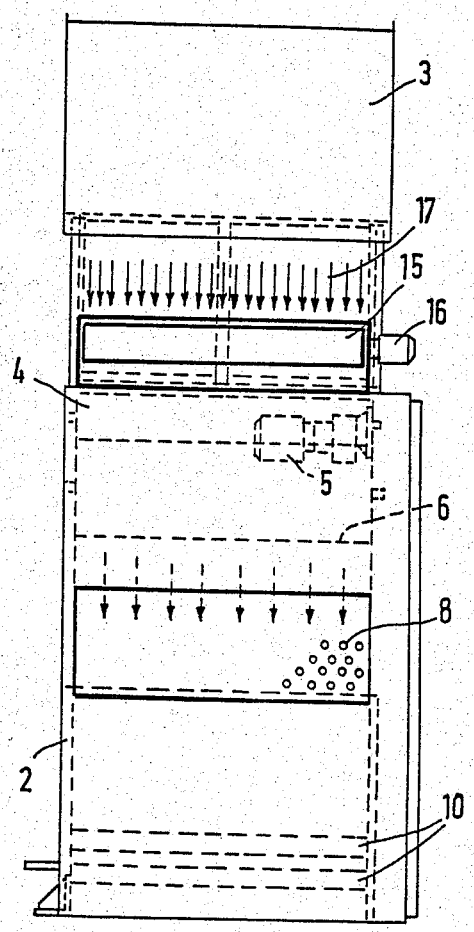
FIG. 2 is a view of the feeding device of FIG. 1 in direction of arrow II.

The feeding device 1 comprises a housing 2 with an inlet 3 for the spinning material as well as an intake roller 4 mounted beneath the latter and driven by a gear motor 5. Below the intake roller 4, there is provided an opening device 6, e.g. a beater roller at which the material gets into a duct 7 whose one wall 8 is reciprocated by a vibrator 9 about the pivot 10, while the other wall 11 of the duct is stationary. Two take-off rollers 12 through which the condensed material is continuously removed to be conveyed to a processing machine are provided at the lower end of duct 7.

To intensify condensation of the material in duct 7 and to improve the distribution of the flocks over the width of the duct, air is introduced at 14 by means of a cross current blower transverse current blower 15 extending over the width of the duct and driven by motor 16. Due to the cross current blower 15 air is absorbed uniformly over the duct width as indicated by the arrows 17 and uniformly pressed into the duct 7. The air may escape through a perforated surface 18 at the vibrating wall 8 to flow through the housing 2. The way of introducing air by means of the cross current blower contributes to a substantially more uniform distribution of the flocks in the duct 7.

To ensure additionally a more uniform depositing of the flocks in the duct, the drive motor 5 for the intake roller 4 is designed to have at least two speeds. Suitably, motor 5 has changeable poles and a 1:2 winding, thus permitting to use two speeds for the intake rollers 4. The height of the material column in the duct 7 is controlled by a scanning means 20, which may be a selenium cell, a light barrier or an ultrasound barrier. Upon reaching the filling height of duct 7, the drive motor 5 for the intake roller 4 is switched over from the quick speed to the slow speed thus ensuring that less material is supplied. If the material level has dropped below the barrier 20, the motor is changed over again to quick speed.

If, during a predetermined time, the motor 5 is not changed over to quick speed, the time lag 21 becomes effective to stop the feeding device thus avoiding overfilling. Upon the drop of the filling height of the material in the duct 7 below the level mark of barrier 20, a signal is released for the quick motion of the drive 5 for the intake roller 4 thus putting again into operation the intake mechanism. As a result, the continuous feeding will become operative again.

Figure 3:
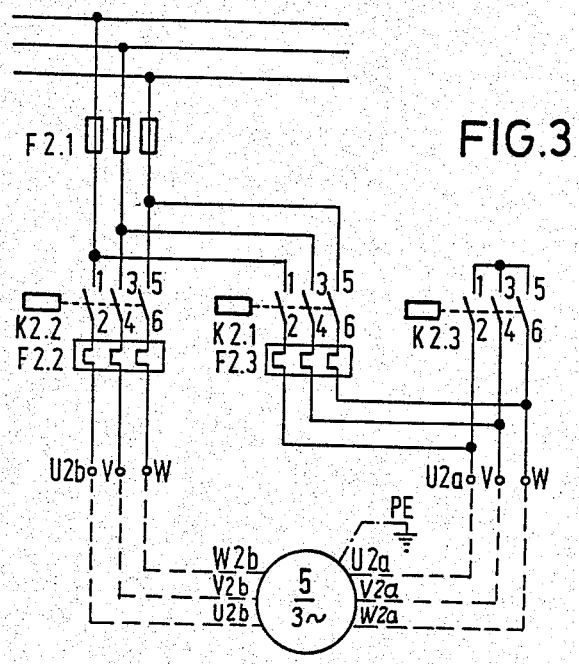
FIG. 3 is a schematic wiring diagram of the driving means of the intake device.
Figure 4:
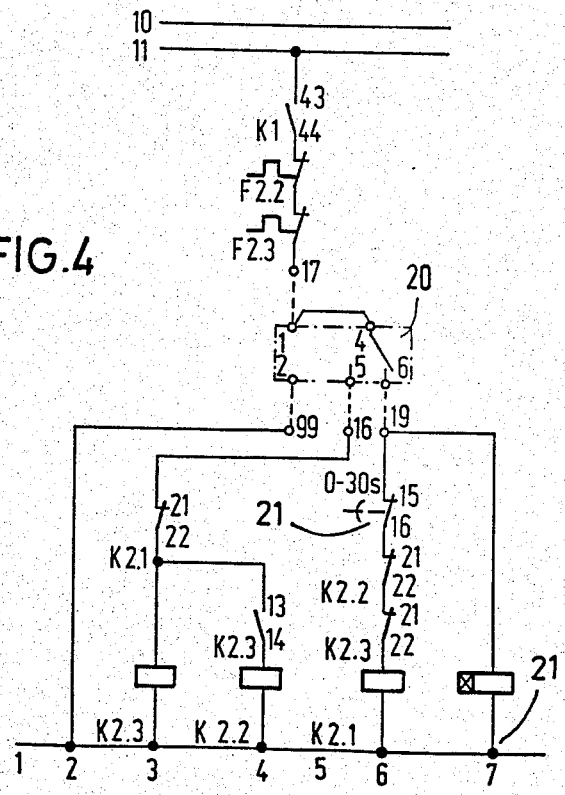
FIG. 4 is a schematic wiring diagram for the control portion of the gear motor drive of the intake roller.

In FIGS. 3 and 4, wiring diagrams for the intake system are shown, FIG. 3 reflecting the wiring diagram for the power and FIG. 4 for the control portion of the respective motor 5. Motor 5 may comprise the Dahlander-circuit known per se for two speed stages. F is meant to indicate motor fusibles for the respective conductors or overcurrent trips. K refers to contactors, i.e. air-break contactors in the instant case. In the control portion of FIG. 4, the line 10 is a normal line while line 11 is a so-called "emergency-out" line to which the control lines are connected preferably.

Unless the predetermined filling height does exist in duct 7, contacts 4 and 5 at the ultrasound barrier 20 are closed. In other words, motor 5 is driven at a high speed via contactors K2.2 and K2.3. If the sound path of the ultrasound barrier 20 is interrupted, contacts 4 and 6 are closed. Therefore, motor 5 is running at the lower speed. Then, the time lag 21 will become effective. If the sound path of the ultrasound barrier will not be free for 30 seconds, the drive is disconnected accordingly.

What is claimed is:

1. Apparatus for feeding flocculent fiber material, e.g., cotton, synthetic fibers, etc., to processing machines such as carding engines, etc., comprising a duct having an inlet end portion and an outlet end portion, said duct inlet end portion having a predetermined width, means for introducing fiber material into said duct inlet end portion across generally the entirety of the predetermined width thereof, means downstream of said introducing means of said generally same predetermined width for opening the fiber material, means for condensing said fiber material in said duct outlet end portion, means for discharging the fiber material from said duct outlet end portion, means for scanning the height of the fiber material in said duct above said duct outlet end portion, means for responding to said scanning means to control the height of the fiber material in said duct, means for blowing air into and uniformly across the predetermined width of said duct inlet end portion, said air blowing means being a transverse current blower extending the predetermined width of said duct inlet end portion and opening means, said transverse current blower being positioned above said duct inlet, said transverse current blower having an inlet and an outlet each corresponding in length to said predetermined width, said transverse current blower providing an unrestricted current of air between said inlet and said outlet, said outlet being directed downwardly into said duct inlet end portion, and means for operating said transverse current blower at low air pressures and high air throughput.

2. The apparatus as defined in claim 1 wherein said fiber material introducing means is a roller and means for rotating said fiber material introducing roller at at least two speeds.

3. The apparatus as defined in claim 1 wherein said fiber material introducing means is a roller, and means for rotating said fiber material roller at high and low speeds in response to said responding means at respective low and high levels of fiber material in said duct.

4. The apparatus as defined in claim 3 including means for stopping said fiber material introducing roller through a time-delay relay if the rotating means is not switched to high speed for a predetermined time.

* * * * *